US006252933B1

(12) United States Patent
Artig

(10) Patent No.: US 6,252,933 B1
(45) Date of Patent: Jun. 26, 2001

(54) X-RAY GENERATING APPARATUS

(75) Inventor: Christopher F. Artig, Summit City, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 8 days.

(21) Appl. No.: 09/609,615

(22) Filed: Jul. 5, 2000

Related U.S. Application Data

(63) Continuation of application No. 09/137,950, filed on Aug. 21, 1998, now Pat. No. 6,134,299, which is a continuation-in-part of application No. 08/920,747, filed on Aug. 29, 1997, now Pat. No. 5,802,140.

(51) Int. Cl.[7] ..... H01J 35/00

(52) U.S. Cl. ..... 378/121; 378/136; 378/138; 378/141

(58) Field of Search ..... 378/136, 121, 378/125, 137, 138, 139, 141, 142, 203

(56) References Cited

U.S. PATENT DOCUMENTS 4,811,375 * 3/1989 Klostermann ..... 378/141 X
4,841,557 * 6/1989 Haberrecker et al. ..... 378/141
5,056,126 * 10/1991 Klostermann et al. ..... 378/127
5,515,413 * 5/1996 Kaudsen et al. ..... 378/136
5,703,924 * 12/1997 Hell et al. ..... 378/136
5,802,140 * 9/1998 Virshup et al. ..... 378/136
6,134,299 * 10/2000 Artig ..... 378/121

* cited by examiner

*Primary Examiner*—David P. Porta
*Assistant Examiner*—Daniel S. Felten
(74) *Attorney, Agent, or Firm*—Workman, Nydegger & Seeley

(57) ABSTRACT

Air cooled x-ray generating apparatus is provided with a unitary vacuum enclosure having a rotating anode target and a cathode assembly for generating x-rays. The cathode assembly may be placed within the vacuum enclosure through an opening in the top wall thereof, and comprises a disk which completely covers this opening. The unitary vacuum enclosure and the disk form a radiation shield. A plurality of fins are disposed on the exterior side wall of the vacuum enclosure, and a shroud is attached to the fins to provide additional protection of ambient against radiation. The cathode assembly may be placed through a side wall of the vacuum enclosure. The additional protection against excessive radiation in this design is provided by a shielding member placed in proximity to the anode target. The shielding member extends from the side wall of the enclosure and is substantially parallel to the top wall.

5 Claims, 3 Drawing Sheets

X-RAY GENERATING APPARATUS

This application is a continuation of U.S. application Ser. No. 09/137,950 filed Aug. 21, 1998, now U.S. Pat. No. 6,134,299 which is a continuation-in-part of the U.S. application Ser. No. 08/920,747 filed Aug. 29, 1997, now U.S. Pat. No. 5,802,140, each of which is incorporated herein by reference.

BACKGROUND OF THE INVENTION

The present invention relates to x-ray generating apparatus, and in particular to x-ray tubes with an improved unitary vacuum housing design which allows for a radiation protection and direct heat transmission through a body of the unitary vacuum housing.

The x-ray generating apparatus generally comprises a vacuum enclosure with an anode assembly and a cathode assembly spaced therebetween. The cathode assembly comprises an electron emitting cathode which is disposed so as to direct a beam of electrons onto a focal spot of an anode target of the anode assembly. In operation, electrons emitting by the cathode are accelerated towards the anode target by a high voltage created between the cathode and the anode target. The accelerated electrons impinge on the focal spot area of the anode target with sufficient kinetic energy to generate a beam of x-rays which passes through a window in the vacuum enclosure.

However, only about one percent of the input energy is converted into x-radiation. The vast majority of the input energy is converted into thermal energy which is stored in the mass of the anode assembly. It is known in the art that by rotating the anode the heat generated during x-ray production can be spread over a larger anode target area. To improve the heat transfer by radiation the anode assembly is coated in a special way and is cooled by forced convection with, for example, a dielectric liquid as disclosed in the U.S. Pat. No. 4,928,296. The excessive thermal energy from the anode assembly is dissipated by thermal radiation to the surrounding enclosure.

In conventionally designed x-ray generating apparatus the vacuum enclosure is placed in a housing which serves as a container for cooling medium, typically cooling fluid or the forced air. In fluid cooled x-ray apparatus, the type disclosed for example in the U.S. Pat. No. 4,841,557, the rotating anode x-ray tube is immersed into the housing filled with an insulating fluid such as a transformer oil which is circulated by a pump for at least partially dissipating the heat from the vacuum enclosure.

The air cooled x-ray tube disclosed in the U.S. Pat. No. 5,056,126 comprises a housing with disposed therein an evacuated envelope having a cathode and an anode that are capable of being biased to a voltage in a range between about 1 kV and 200 kV, and a heat cage formed of a heat conducting material. The heat cage is provided within the interior of the vacuum enclosure surrounding an anode target. The heat cage absorbs heat from the anode and transports it to the end portion of the vacuum enclosure, and then to the exterior of the housing for dissipation by the air flow. The excessive radiation from the x-ray tube is blocked from exiting the housing by a lead liner which is provided between the evacuated envelope and the housing. The lead liner serves also as a massive heat sink for the x-ray tube.

Being advantageous in some respects the air cooled tube design has certain drawbacks. The presence of the heat cage inside the evacuated envelope elongates the heat path leading to a heat dissipation which results in excessive temperature built up over the exterior of the vacuum enclosure which may damage the lead liner.

Therefore it is an object of the present invention to provide a compact x-ray generating apparatus with reduced number of components resulting increased reliability and reduced manufacturing costs.

It is another object of the present invention to provide the x-ray generating apparatus having a multi-functional vacuum enclosure which serves as a radiation shield, as a heat reservoir for balancing the temperature within the vacuum enclosure in case of power loss and as a direct heat transfer element between an anode assembly and an air cooling system.

It is yet another object of the present invention to provide the air cooling x-ray generating apparatus comprising a multi-functional mounting block which serves as an installation element, as a heat reservoir and as an element of a cooling system.

SUMMARY OF THE INVENTION

In accordance with one embodiment of the present invention, there is provided an x-ray generating apparatus which comprises a unitary vacuum enclosure formed by a cylindrically shaped body having side, top and bottom walls with respective openings therein. The top and side walls are made of materials capable to provide a required radiation shielding which does not exceed the FDA requirement of radiation transmission equals to 100 mRad/hr at 1 meter from the x-ray generating apparatus with 150 kV at rated power. The unitary vacuum enclosure has an anode assembly with a rotating anode target and a cathode assembly spaced therebetween. The unitary vacuum enclosure has a thermal capacity that is substantially larger than a thermal capacity of the anode target. The cathode assembly has an electron source for emitting electrons that strikes the rotating anode target to generate x-rays which are released through an x-ray window coupled to the opening in the side wall of the unitary vacuum enclosure, the cathode assembly comprises further a mounting structure for holding said electron source, and a disk made of a high Z-material and attached to the mounting structure and facing the anode target for shielding the opening in the top wall of the unitary vacuum enclosure against the x-rays. The outer side wall of the unitary vacuum enclosure comprises a plurality of fins disposed thereon. A shroud is attached to the fins and extends over the outer perimeter of the side wall and partially over the top wall.

In accordance with another embodiment of the present invention the x-ray generating apparatus comprises a top wall and a cylindrical side wall with a protruded inwardly shielding member. The shielding member is substantially parallel to the top wall. It forms an upper and lower portion within the vacuum enclosure, wherein an anode assembly and an electron source of cathode assembly are disposed in the lower portion, while the mounting structure for holding the electron source is disposed in the upper portion of vacuum enclosure. The cathode assembly is placed within the vacuum enclosure through an aperture within the upper portion of the side wall of the vacuum enclosure. A conical high-voltage insulator is utilized to seal the vacuum enclosure within this aperture.

These and other objectives and advantages of the present invention will become clear from the detailed description given below in which preferred embodiments are described in relation to the drawings. The detailed descriptions presented to illustrate the present invention, but is not intended to limit it.

BRIEF DESCRIPTION OF THE DRAWINGS

Embodiments of the present invention are shown by way of examples in the accompanying drawings, wherein.

The accompanying drawings, which are incorporated in and form a part of the specification, illustrate the embodiments of the present invention and, together with description, serve to explain the principles of the invention. In the drawings.

DETAILED DESCRIPTION OF THE PREFERRED EMBODIMENTS

Figure 1:
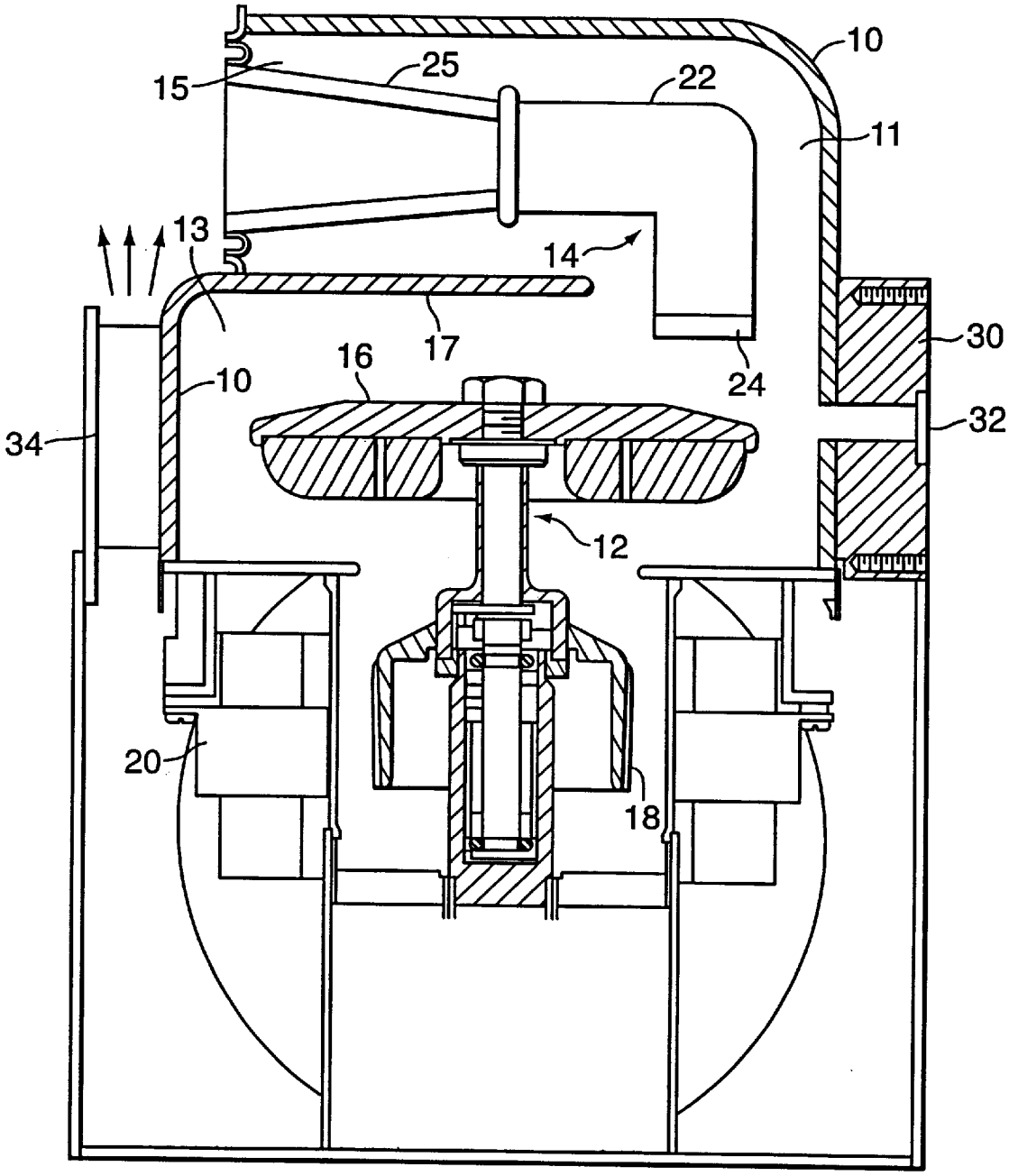
FIG. 1 is a cross-sectional view of an x-ray generating apparatus embodying a unitary vacuum enclosure of the present invention with a side wall comprising a shielding member that is substantially parallel to a top wall.

An x-ray generating apparatus according to one embodiment of the present invention is shown in FIG. 1 and comprises unitary vacuum enclosure 10 with upper portion 11 and lower portion 13. Rotating anode assembly 12 is disposed within lower portion 13, and cathode assembly 14 is disposed mostly within upper portion 11. Rotating anode assembly 12 comprises anode target 16 which is connected via a shaft to rotor 18 for rotation. Stator 20 is disposed outside unitary vacuum enclosure 10 proximate to rotor 18. Cathode assembly 14 comprises mounting structure 22 with electron source 24 mounted thereon. Cathode assembly 14 is placed within the vacuum enclosure through opening 15 in a side wall of upper portion 11 of unitary vacuum enclosure 10 and vacuum tight thereto by ceramic insulator 25. Unitary vacuum enclosure 10 has protrusion 17 within upper portion 11 that projects therein from the side wall thereof. Protrusion 17 provides additional shielding against excessive radiation including off-focus radiation caused by scattered electrons.

Mounting block 30 has a cylindrically shaped body with a port therein, and it is mechanically attached to unitary vacuum enclosure 10 so as the port is coupled to an x-ray opening in the side wall of the unitary vacuum enclosure. Mounting block 30 may be either brazed or bolted to the vacuum enclosure.

High voltage means (not shown) are proved for creating a potential between cathode assembly 14 and anode assembly 12 to cause an electron beam generated by electron source 24 to strike anode target 16 with sufficient energy to generate x-rays. The anode assembly is maintained at a positive voltage of about +75 kv while the cathode assembly is maintained at an equally negative voltage of about −75 KV. Window 32 permits transmission of x-rays. An x-ray window may be attached to a window adapter. The window adapter being sealed to the side wall forms an extended part of unitary vacuum enclosure 10.

Mounting block 30 may house the window adapter or x-ray window may be attached to the end of the port opposite to the x-ray opening. The material of the window adapter must be thermally compatible with the material of vacuum enclosure 10 and material of window 32. The remote positioning of the window from the anode target allows to reduce the temperature of the window. It is especially important since in operation, the temperature within the vacuum enclosure is higher in the window area due to the contribution of off focus radiation due to secondary electron bombardment from electrons back scattered from the focal spot on the anode target. Since the electrons are scattered at random angles only a small portion of them travel so as to heat the window in its new location.

Figure 2:
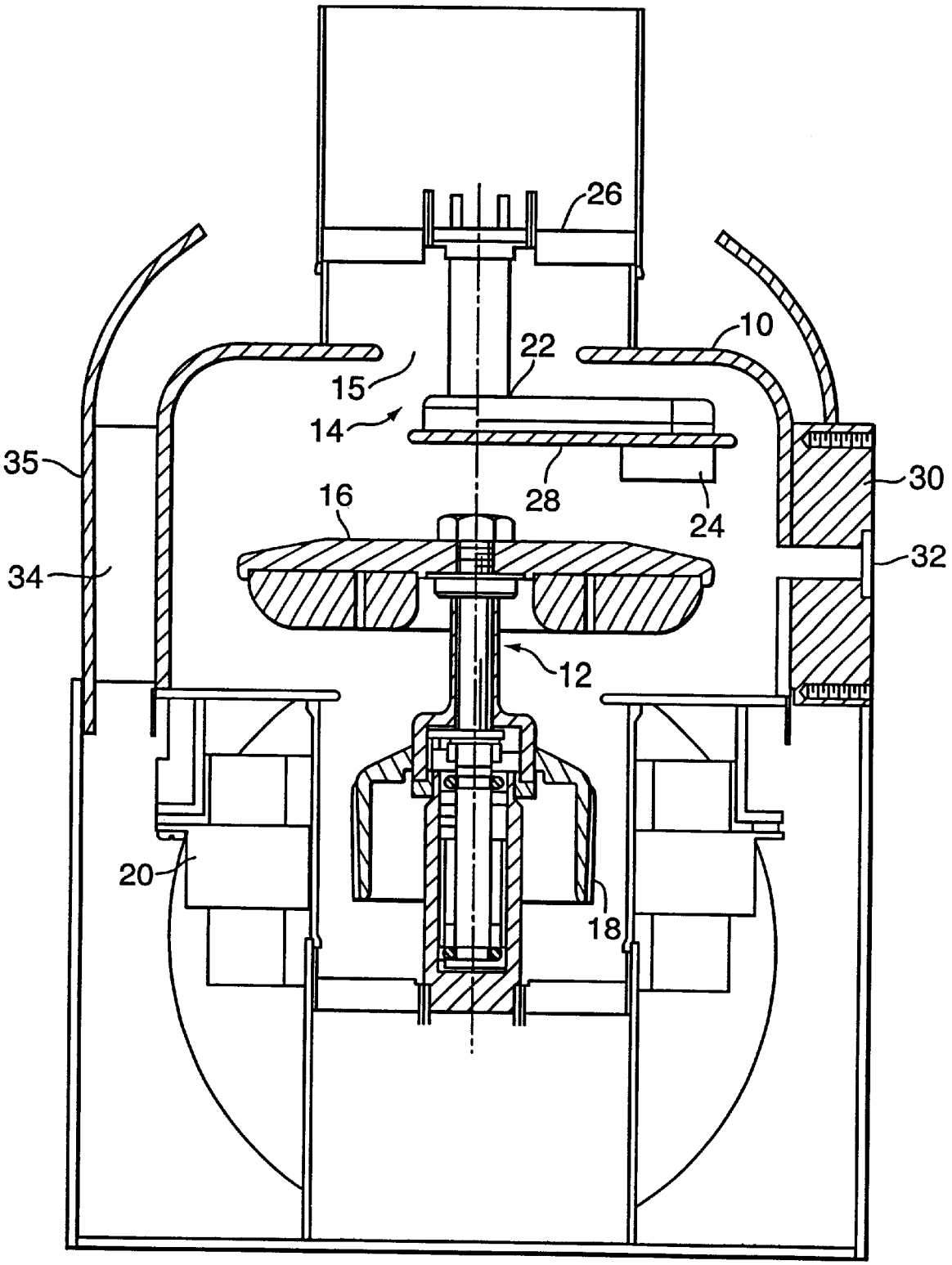
FIG. 2 is a cross-sectional view of an x-ray generating apparatus with a protective shroud that is attached to cooling fins disposed over the side wall of the unitary vacuum enclosure.
Figure 3:
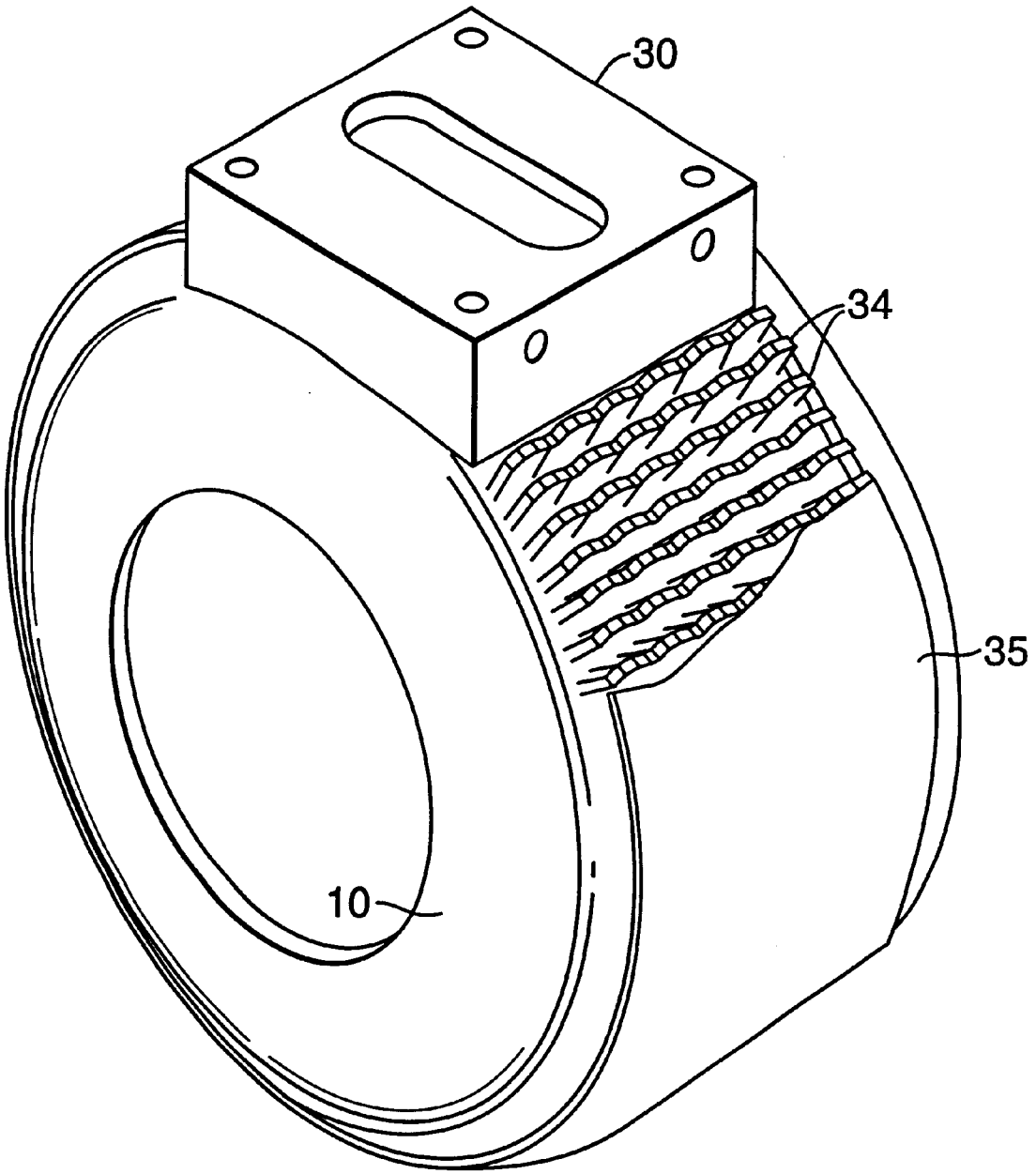
FIG. 3 is a prospective view of the unitary vacuum enclosure of x-ray generating apparatus of the present invention showing a position of a mounting block, fins and shroud.

Another embodiment of the present invention is shown in FIG. 2. The identical numerical designations are given to the same elements shown in FIG. 1 and FIG. 2. In the embodiment of FIG. 2 cathode assembly 14 with mounting structure 22 and electron source 24 attached thereto is placed within unitary vacuum enclosure 10 through opening 15 in its top wall and vacuum tight by ceramic insulator 26. Cathode assembly 14 further comprises disk 28 that is attached to mounting structure 22. The disk has an aperture for protruding electron source 24 therethrough. Cooling fins 34 are disposed outside of unitary vacuum enclosure 10 as shown in a perspective view of unitary vacuum enclosure 10 in FIG. 3. Shroud 35 is disposed over fins 34 and is attached thereto. Shroud 35 provides additional protection against excessive radiation. According to this embodiment the vacuum enclosure may be made from inexpensive materials such as Copper, Kovar or low thermal expansion Iron alloys and stainless steel instead of expensive and difficult for manufacturing processes high-Z materials. The shroud should be made from high-Z materials, for example, Tin, Antimony, Tungsten, or Bismuth. The preferable material for the shroud would be a composite of plastic and Tungsten. To achieve an extra protection of the environment against radiation, the outside surface of the Kovar vacuum enclosure may be coated by the layer of Tungsten, since both these materials have matching thermal expansion. The thermal match between the layer and the vacuum enclosure is improved when about 10% of Iron is added to the shielding layer. The cooling fins are brazed or welded on the outside of the shielding layer.

Mounting block 30 in addition to its traditional installation function is used for increasing the thermal capacity of the apparatus and along with fins 34 placed over the perimeter of unitary vacuum enclosure 10 for enhancing heat transfer from the anode assembly to the region outside the vacuum enclosure.

The x-ray generating apparatus of the present invention utilizes air cooling technique when heat from the vacuum enclosure dissipates by convection due to air flow provided by the fan. Depending on the application of the x-ray apparatus the air may be forced to flow axially as shown in FIG. 1.

The unitary vacuum enclosure of the present invention along with the shielding member or the shroud and the disk functions as a radiation shield. The choice of material for the enclosure and its thickness is defined by its ability to lower the radiation transmission to one fifth of the FDA requirement which equals 20 mRad/hr at 1 meter distance from the x-ray generating apparatus with 150 KV potential maintained between anode and cathode assemblies at rated power of the beam.

The present invention utilizing multi-functional unitary vacuum enclosures allows for manufacturing a compact x-ray generating apparatus with fewer components and resulting high reliability and lower costs. The walls of the unitary vacuum enclosure are used for direct transmission of heat therethrough, for radiation shielding and for heat accumulation due to power loss when the anode target is at full heat storage capacity.

The present invention has been described with reference to the preferred embodiments. Various changes, substitutions and alterations will be obvious to others skilled in the art upon reading and understanding the preceding detailed description. It is intended that the invention be construed as including all such modifications and alterations if they come within the scope of the appended claims or the equivalents thereof.

What is claimed is:

1. An X-ray tube comprising:

a unitary vacuum enclosure having an outer wall;

an anode assembly having a rotating anode target disposed within the unitary vacuum enclosure;

a cathode assembly disposed within said unitary vacuum enclosure and having an electron source capable of emitting electrons that strike the rotating anode target so as to generate X-rays;

an x-ray window comprised of an x-ray transmissive material; and a passageway having a first end affixed to an outer wall of the vacuum enclosure, and a second end affixed to the x-ray window in a manner so that the x-ray window is positioned a predetermined distance from the outer wall of the vacuum enclosure and wherein at least a portion of the X-rays pass through the passageway and are released through the x-ray window.

2. An x-ray tube as defined in claim 1, wherein the passageway is a bore formed through a body.

3. An x-ray tube as defined in claim 1, wherein the x-ray window is positioned a predetermined distance from the outer wall of the vacuum enclosure so as to prevent substantially all electrons that are back scattered from the rotating anode target from striking the x-ray window.

4. An x-ray tube as defined in claim 1, further comprising an x-ray port formed through the outer wall of the vacuum enclosure proximate to the first end of the passageway.

5. An x-ray tube as defined in claim 4, wherein the cross-sectional area of the x-ray port is smaller than the adjacent cross-sectional area of the passageway.

* * * * *